US006402407B1

(12) United States Patent
Goldstein

(10) Patent No.: US 6,402,407 B1
(45) Date of Patent: Jun. 11, 2002

(54) DEVICE FOR HOLDING A WRITING INSTRUMENT

(76) Inventor: Cassidy Goldstein, 5 Deerfield La., Scarsdale, NY (US) 10583

( * ) Notice: Subject to any disclaimer, the term of this patent is extended or adjusted under 35 U.S.C. 154(b) by 0 days.

(21) Appl. No.: 09/610,542

(22) Filed: Jun. 29, 2000

(51) Int. Cl.[7] ..... A46B 5/02
(52) U.S. Cl. ..... 401/6; 401/88
(58) Field of Search ..... 401/6, 88, 92, 401/98; D19/41, 43; 220/229; 15/435, 437, 444

(56) References Cited

U.S. PATENT DOCUMENTS

| | | | | | |
|---|---|---|---|---|---|
| 1,151,933 | A | | 8/1915 | Fleming | |
| 1,861,466 | A | | 6/1932 | Bafetti | |
| 2,205,907 | A | | 6/1940 | Oxley | |
| 2,213,465 | A | * | 9/1940 | Gay | 220/229 |
| 2,290,886 | A | * | 7/1942 | Lenz | 401/93 |
| 2,436,291 | A | * | 2/1948 | Daniel | 220/229 |
| 2,591,831 | A | | 4/1952 | Knuff | |
| 2,762,336 | A | | 9/1956 | Estes | |
| 2,870,740 | A | | 1/1959 | Vogt | |
| 3,086,674 | A | * | 4/1963 | Sheuerman | 220/229 |
| 4,415,092 | A | | 11/1983 | Boyer | |
| 4,468,146 | A | | 8/1984 | Tabachnik | |
| 4,600,112 | A | * | 7/1986 | Shillington et al. | 220/229 |
| 4,948,009 | A | * | 8/1990 | Sawatani | 220/229 |
| 5,025,947 | A | * | 6/1991 | Leone | 220/229 |
| D360,223 | S | | 7/1995 | Lamber | |
| D372,049 | S | | 7/1996 | Anderson | |
| 5,551,787 | A | * | 9/1996 | Rosenthal | 401/88 |
| 6,173,851 | B1 | * | 1/2001 | Hague et al. | 220/229 |

FOREIGN PATENT DOCUMENTS

| | | | | |
|---|---|---|---|---|
| GB | 15979 | * | 7/1910 | 401/88 |
| GB | 160079 | * | 3/1921 | 401/88 |
| DE | 42 | * | 7/1989 | 401/92 |

* cited by examiner

*Primary Examiner*—Charles R. Eloshway
(74) *Attorney, Agent, or Firm*—Buckley, Maschoff Talwalkar & Allison

(57) ABSTRACT

A holder for a writing instrument includes a body portion having at least one open end and a top portion adapted to fit on the open end. The top portion includes at least one flexible holding member positioned within a perimeter of the top portion and adapted to securely hold a writing instrument.

10 Claims, 3 Drawing Sheets

DEVICE FOR HOLDING A WRITING INSTRUMENT

FIELD OF THE INVENTION

The present invention relates to the field of devices and apparatus for holding writing or drawing materials.

BACKGROUND OF THE INVENTION

Children love to draw, write, and doodle using crayons, chalk, and other writing instruments. This activity is not only enjoyable, but it plays an important role in a child's development. Children are able to express themselves, interact with other children, and learn by writing and drawing.

Children have some limitations in their ability to use certain writing instruments. For example, many children have small hands that are unable to effectively grip small diameter writing instruments. For example, chalk and crayons are approximately 0.25 to 0.35 inches in diameter. It can be very awkward for a child with small hands to use these writing instruments.

Further, many writing instruments used by children are relatively fragile. As a result, children frequently break chalk or crayons. This is inefficient and wasteful.

Most writing instruments used by children can be relatively messy. Some parents, for example, discourage children from using crayons or chalk in rooms or situations where the parent cannot easily clean up the mess. It would be desirable to provide a device that reduces the mess created by the use of these writing instruments.

Older individuals, such as people suffering from arthritis or other physical impairments, suffer from the same difficulties in the use of writing instruments. It would be desirable to provide a holder for writing instruments which overcame these problems.

A number of holders for writing instruments have been proposed. For example, U.S. Pat. Nos. 1,151,933 (Fleming), U.S. Pat. No. 2,205,907 (Oxley), U.S. Pat. No. 2,870,740 (Vogt), and U.S. Pat. No. 4,415,092 (Boyer), all described holders for writing instruments which rely on friction to hold the writing instrument in the holder. Unfortunately, each of these holders suffer in that it can be difficult and awkward, especially for a young child, to force a crayon or piece of chalk into the holder. These holders are also undesirable because they tend to break crayon or chalk when installed into the holder. It is difficult and messy to remove these small broken pieces from the holders.

Other holders have also been described. For example, U.S. Patent Nos. 1,861,466 (Bafetti), U.S. Pat. No. 2,591,831 (Knuff), U.S. Pat. No. 2,762,336 (Estes), U.S. Pat. No. 4,468,146 (Tabachnik), U.S. Pat. No. 5,048,989 (Stageman), Re 34,194 (Stowell et al), U.S. Pat. No. 5,490,738 (Pearce), and U.S. Pat. No. 5,779,381 (Muelver) all describe holders for writing instruments which require complex and expensive machining or assembly. Further, some of these holders include small or moving parts that can be dangerous to a small child. Some of these holders are relatively difficult to operate making them unsuitable for small children.

It would be desirable to provide a holder for writing instruments which is inexpensively manufactured, easily assembled, and safe for children or other individuals. Preferably, the holder is easily used, keeps the user clean, and provides a good surface for grasping by individuals who have a difficult time holding small objects.

SUMMARY OF THE INVENTION

Embodiments of the present invention provide an improved holding device for holding writing instruments.

In one embodiment, a holder for a writing instrument has a body portion with an interior cross section larger than an exterior cross section of the writing instrument. A top portion is also provided which includes at least one flexible holding portion adapted to securely hold the writing instrument within the body portion. In one embodiment, the top portion is detachably mounted to the body portion. In another embodiment, the top portion is fixedly attached to the body portion in a manner that allows access to the interior of the holding portion, e.g., for cleaning of the holding portion.

In one preferred embodiment, the body portion is an elongated cylinder closed on one end and open on the other. The body portion may be made of a transparent, easily formed material such as a plastic. The top portion may also be formed of plastic. The flexible holding portion may be formed of plastic or an elastomeric material that provides a firm grip for an inserted writing instrument.

With these and other advantages and features of the invention that will become hereinafter apparent, the nature of the invention may be more clearly understood by reference to the following detailed description of the invention, the appended claims and to the several drawings attached herein.

DETAILED DESCRIPTION OF THE INVENTION

Figure 1:
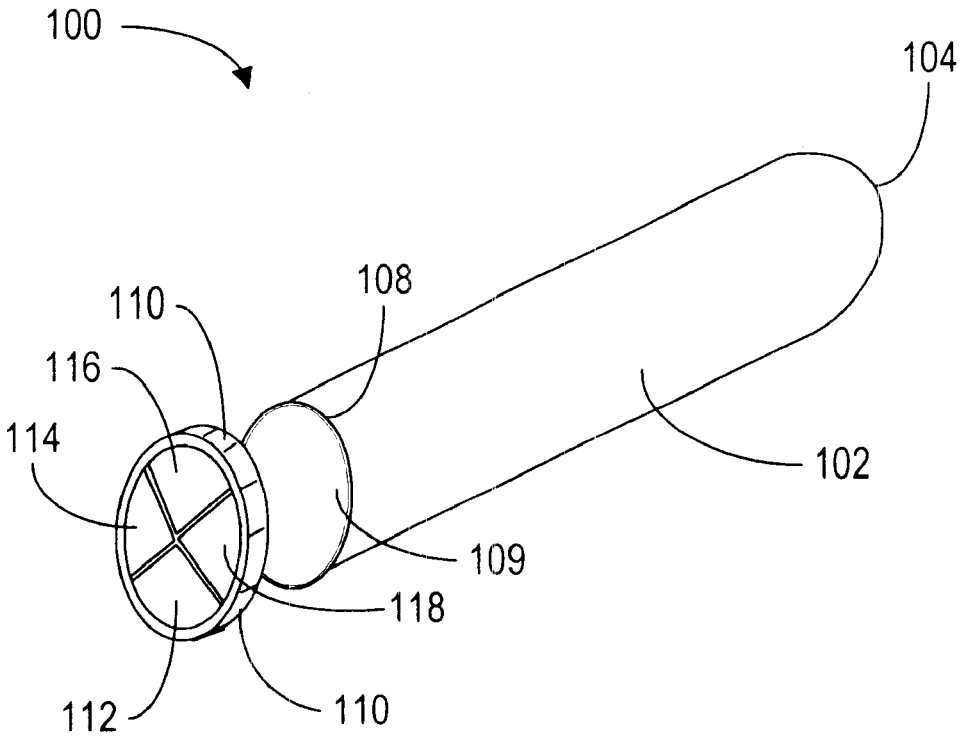
FIG. 1 is a front exploded view of a holding device according to an embodiment of the present invention.

Applicant has recognized that a need exists for a holder for writing instruments which is easily and inexpensively manufactured and assembled, which also is suitable for use by children. In particular, Applicant has recognized that children (and others who have difficulties gripping small objects) require a holder which is easily used, keeps the user clean, and provides a good surface for grasping and manipulating the writing instrument.

Features of embodiments of the present invention will now be described by first referring to FIG. 1 which is a front exploded view of a holding device 100 according to one embodiment of the present invention. The holding device 100 includes a body 102 having an end section 104, a flange 108, and an open end section 109. The body 102 may be formed of a thin, non-toxic plastic material. The body 102 may be opaque or clear. Preferably, the diameter of the body 102 is selected to provide a firm grip for children with small hands or impaired individuals. The exterior surface of the body 102 may be textured to provide an even firmer grip.

The holding device 100 also includes a top portion 106 which, in the embodiment depicted in FIG. 1, is formed separately from the body 102. The top portion 106 is sized to mate securely over the open end section 109 and the flange 108 of the body 102. The top portion 106 may include a plurality of serrations 110 disposed around an exterior perimeter of the top portion 106 to aid in removal of the top portion 106 from the body 102. In one embodiment, the top portion 106 is formed of a non-toxic, elastomeric material which is sized and formed to be safe for use by children. Those skilled in the art will recognize that the top portion 106 may couple to the body 102 in any of a number of ways. For example, the top portion 106 and the body 102 may be threaded in a manner which allows the top portion 106 to screw onto the body 102.

The top portion 106 further includes a number of holding portions 112, 114, 116, and 118. These holding portions 112–118 are arrayed around a perimeter of the top portion 106 in a manner which is designed to enable a writing instrument (not shown) to be inserted through the perimeter of the top portion 106 and to securely hold the writing instrument in position within the perimeter of the top portion 106. While Applicant has found that the configuration of holding portions depicted in FIG. 1 produces desirable results, those skilled in the art will recognize that a different number of holding portions may be provided, so long as the writing instrument is securely held within the perimeter of the top portion 106.

Figure 2:
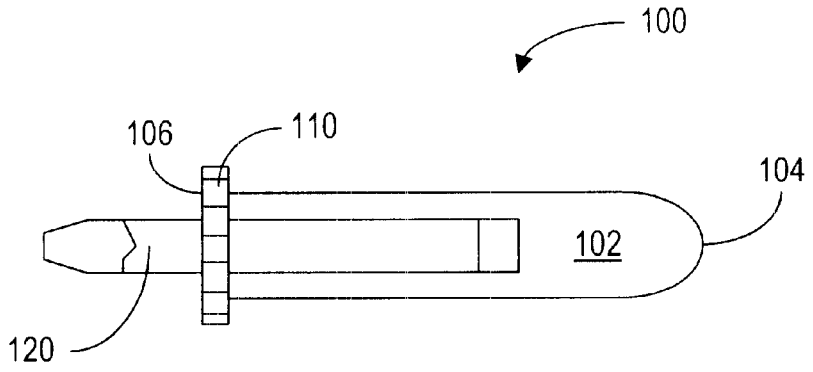
FIG. 2 is a side view of the holding device of FIG. 1.

Reference is now made to FIG. 2 where a side view of the holder 100 is shown with a writing instrument 120 held within the holder 100. As depicted, the holder 100 includes a body 102 mated with a top portion 106. The writing instrument 120 is securely held within a perimeter of the top portion 106 so that an unused end of the writing instrument is disposed within the interior of the body 102. This helps to ensure that messy writing instruments, such as crayons or chalk, do not accumulate on the user's hands. Further, the body 102 serves to protect the writing instrument 120 from breakage. The circumference of the body 102, which is larger than the circumference of the writing instrument 120, makes it easy for children with small hands or individuals with disabilities to grip and manipulate. As the writing instrument 120 wears down, the user simply needs to pull on the exposed end of the writing instrument 120 to expose more of the instrument.

Figure 3:
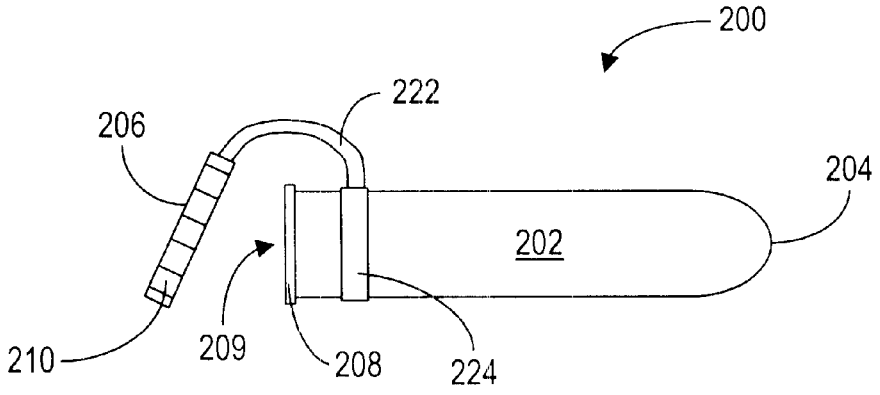
FIG. 3 is a side view of an alternative embodiment of the holding device of FIG. 1.

Referring now to FIG. 3, a side view of an alternative embodiment of a holder 200 is shown. In this embodiment, the holder 200 has a elongated body 202 having a closed end 204 and an open end 209. A top portion 206 is provided which is attached to the body 202 via a strap 222. The top portion 206 mates with the body 202 at the open end 209 by fitting over a flange 208. Through use of the strap 222, the top portion 206 can be kept with the body 202 and not lost. Further, attachment of the two portions helps to ensure that the smaller top portion 206 is not swallowed by a small child.

Figure 4:
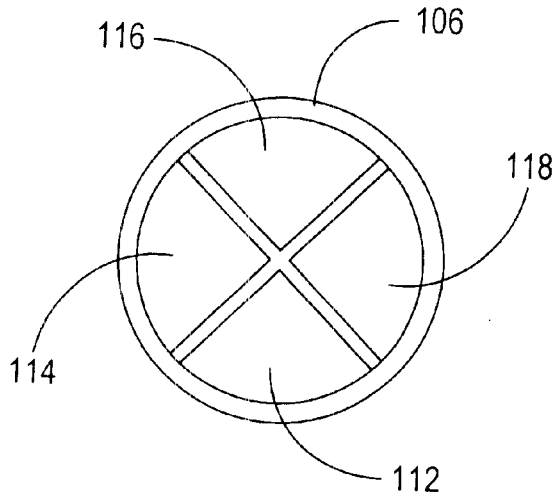
FIG. 4 is a front view of a top portion of the holding device of FIG. 1.

Reference is now made to FIG. 4, which is a front view of the top portion 106 of FIG. 1. As shown, the top portion 106 includes several holding portions 112–118 which are disposed within a perimeter of the top portion 106. In the embodiment depicted, the holding portions 112–118 are angularly shaped to allow a writing instrument to be inserted within the perimeter of the top portion 106 and securely held therein by friction between the writing instrument and each of the holding portions 112–118. Those skilled in the art will recognize that any number of holding portions 112–118 may be used so long as a writing instrument may be securely held.

Figure 5:
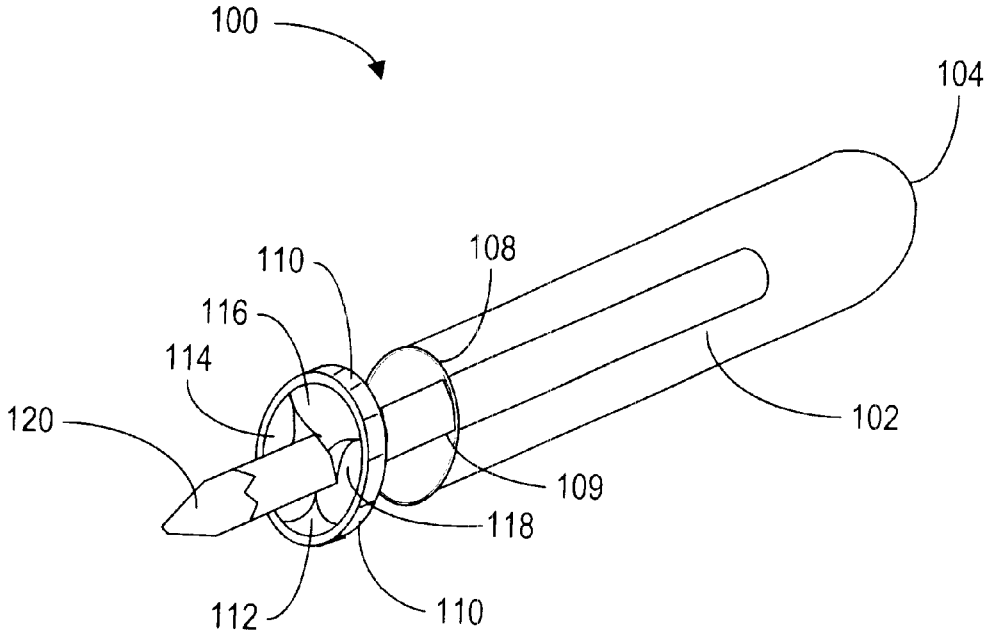
FIG. 5 is a front exploded view of the holding device of FIG. 1 with a writing instrument installed.

Referring now to FIG. 5, a side exploded view of the holder 100 is shown. This view shows the interaction between the holding portions 112–118 of the top portion 102 and the writing instrument 120. Each of the holding portions 112–118 impart a holding force against the writing instrument 120, thereby holding the writing instrument securely in place.

The result is a holder for writing instruments which is cheaply manufactured and easily manipulated and configured. Further, the holder reduces messes and breakage associated with the use of fragile writing instruments such as crayons and chalk, and allows users with small hands or disabilities to easily grip and manipulate the holder and writing instrument.

Although the present invention has been described with respect to a preferred embodiment thereof, those skilled in the art will note that various substitutions may be made to those embodiments described herein without departing from the spirit and scope of the present invention. For example, although the body 102 has been depicted as generally cylindrical in shape, the body 102 may be formed of other shapes as well, so long as the body remains easy to hold and manipulate. Further, the top portion 106 may be fixedly attached to the body 102.

What is claimed is:

1. An apparatus for holding a writing instrument, comprising:

a writing instrument;

a body portion having an interior cross section larger than an exterior cross section of the writing instrument, the body portion comprising a cylinder having a closed end and an open end, with a flange portion disposed around the open end, wherein an exterior of said cylinder is formed to fit within a small hand; and a top portion flexibly attached to the body portion via a strap, the top portion including at least one flexible holding portion positioned within a perimeter of the top portion, the top portion adapted to securely hold the writing instrument within said body portion, the top portion formed to securely mate with the body portion at the flange portion, wherein a tip of said writing instrument projects from said top portion to allow use of said tip for writing.

2. The apparatus of claim 1, wherein the top portion is removably mounted to the body portion.

3. The apparatus of claim 1, wherein the body portion has an exterior diameter selected to provide a user with a comfortable and firm grip.

4. The apparatus of claim 1, wherein the interior cross section of the body portion is slightly larger than the exterior cross section of the writing instrument.

5. The apparatus of claim 1, wherein the top portion includes at least two flexible holding portions positioned within a perimeter of the top portion.

6. The apparatus of claim 1, wherein the top portion includes a plurality of flexible holding portions positioned within a perimeter of the top portion.

7. A holder for holding a writing instrument, comprising;

a writing instrument;

a body formed of a cylinder having a length and an interior cross section, the interior cross section larger than an exterior cross section of the writing instrument, wherein an exterior of said cylinder is formed to fit within a small hand;

a top including at least one flexible holding means positioned within a perimeter of the top and adapted to securely hold the writing instrument; and a strap portion attached at one end to the top and at a second end to said body for attaching said top to said body;

wherein a tip of said writing instrument projects from said top to facilitate writing using said writing instrument.

8. The holder of claim 7, further comprising a flange disposed around a perimeter of one end of the body, mating with the top to securely hold the top on the body.

9. The holder of claim 7, further comprising a plurality of flexible holding means positioned within a perimeter of the top.

10. A device for holding a soft writing instrument in a manner which protects the soft writing instrument and an individual holding the soft writing instrument, comprising:

a soft writing instrument;

a cylindrical body portion having a closed end and an open end, wherein an exterior of said cylindrical body portion is formed to fit within a small hand;

a flange disposed along a perimeter of the open end;

a top portion adapted to securely mate with the flange, the top portion having a plurality of flexible holding members disposed within a perimeter of the top portion, the plurality of flexible holding members for securely holding the soft writing instrument within said cylindrical body without damaging the soft writing instrument; and a strap for connecting the top portion to the cylindrical body portion when the top portion is not securely mated with the body cylindrical body portion;

wherein a writing end of said soft writing instrument projects from said top portion to facilitate use of said soft writing instrument for writing.

* * * * *